US007571818B2

(12) United States Patent
Quick

(10) Patent No.: US 7,571,818 B2
(45) Date of Patent: Aug. 11, 2009

(54) COLOR AND SIZE MATCHING OF WOODEN BOARDS

(75) Inventor: Bradley S. Quick, Staatsburg, NY (US)

(73) Assignee: James L. Taylor Manufacturing Company, Poughkeepsie, NY (US)

( * ) Notice: Subject to any disclaimer, the term of this patent is extended or adjusted under 35 U.S.C. 154(b) by 833 days.

(21) Appl. No.: 10/298,828

(22) Filed: Nov. 18, 2002

(65) Prior Publication Data

US 2004/0098164 A1 May 20, 2004

(51) Int. Cl.
*B07C 5/14* (2006.01)
*B07C 5/342* (2006.01)

(52) U.S. Cl. ..... 209/518; 209/580

(58) Field of Classification Search ..... 209/577, 209/518, 521, 580; 414/270; 144/242.1, 144/2.1, 3.1, 1.1
See application file for complete search history.

(56) References Cited

U.S. PATENT DOCUMENTS

| | | | | |
|---|---|---|---|---|
| 4,278,538 | A | 7/1981 | Lawrence | |
| 4,476,982 | A | 10/1984 | Paddock | |
| 4,624,571 | A | 11/1986 | Salda | |
| 4,926,350 | A * | 5/1990 | Bechtel et al. | 702/36 |
| 4,992,949 | A * | 2/1991 | Arden | 700/223 |
| 5,335,790 | A * | 8/1994 | Geiger et al. | 209/518 |
| 5,351,833 | A | 10/1994 | Quick | |
| 5,533,628 | A | 7/1996 | Tao | |
| 5,544,757 | A * | 8/1996 | Geiger et al. | 209/518 |
| 5,761,070 | A * | 6/1998 | Conners et al. | 700/223 |
| 5,813,542 | A | 9/1998 | Cohn | |
| 5,892,808 | A * | 4/1999 | Goulding et al. | 378/63 |
| 5,960,104 | A * | 9/1999 | Conners et al. | 382/141 |
| 6,031,567 | A * | 2/2000 | Johnson | 348/91 |
| 6,072,890 | A * | 6/2000 | Savard et al. | 382/110 |
| 6,272,437 | B1 * | 8/2001 | Woods et al. | 702/35 |
| 6,722,844 | B2 * | 4/2004 | Lunden | 414/789.5 |
| 6,851,559 | B2 * | 2/2005 | Kairi | 209/518 |
| 2004/0111996 | A1 * | 6/2004 | Heroneme | 52/518 |
| 2006/0035056 | A1 * | 2/2006 | Fuzzell | 428/105 |

* cited by examiner

*Primary Examiner*—Patrick H Mackey
*Assistant Examiner*—Mark Hageman
(74) *Attorney, Agent, or Firm*—Saile Ackerman LLC; Stephen B. Ackerman

(57) ABSTRACT

An apparatus for automatically processing random width wood-boards and selecting a matched set according to their surface colors and widths. The boards are manually placed on a conveyor, from a stacked supply, and subsequently measured for width and color. Thereafter, each board is electronically identified, incrementally tracked and stored in a linear array above the conveying surface. After filling the storage level to its full capacity, a microprocessor in combination with an incremental encoder, selects and matches a set of boards from the stored inventory, while continuously restoring its full capacity, and queuing the best blended order of contiguous boards. Moreover, the matching set of boards will have an overall dimension that falls within a prescribed value.

40 Claims, 6 Drawing Sheets

Apparatus Control Overview Flow

New Board Lifter Queuing Chart

* This question applies only when starting a new batch of boards.

COLOR AND SIZE MATCHING OF WOODEN BOARDS

BACKGROUND OF THE INVENTION (1) Technical Field

This invention relates generally to the sorting of wooden boards for building a panel, and more particularly, to the matching of boards by their visual qualities and width dimensions to form panels within a given overall dimension while minimizing color variations between contiguous boards.

(2) Description of the Prior Art

The following six documents relate to methods and apparatus for sorting objects according to their color or size.

U.S. Pat. No. 5,813,542 issued Sep. 29, 1998 to Cohn describes a method of classifying objects by sensing a multiple color image of at least a portion of the object and producing color signals indicative of a plurality of colors in response to sensing the multiple color images.

U.S. Pat. No. 5,351,833 issued Oct. 4, 1994 to B. S. Quick describes a method for selecting wood stock to form panels of predetermined size by automatically selecting and transmitting to further work stations appropriately sized pieces of stock which, when glued together saves time in the formation of an end product.

U.S. Pat. No. 5,533,628 issued Jul. 9, 1996 to Tao describes a color sorting apparatus employing a conveyor which drops the sorted objects into appropriate bins.

U.S. Pat. No. 4,624,571 issued Nov. 25, 1986 to Salda, et al. shows an apparatus for detecting the coloring of moving tiles for the purpose of dividing their flow into a plurality of flows as a function of the quality of their color.

U.S. Pat. No. 4,476,982 issued Oct. 16, 1984 to Paddock, et al. describes a method and apparatus for grading articles, particularly lemons, according to their surface color.

U.S. Pat. No. 4,278,538 issued Jul. 14, 1981 to Lawrence, et al. describes methods and apparatus for sorting workpieces according to their color signature.

Generally, the steps taken prior to putting together a collection of boards to form a panel of a given overall size, for example, when sorting wood boards for aesthetic blending requires a trained eye to match adjacent boards in a panel array. Dimensional extent, on the other hand, requires a reference standard, or a template to use for measuring or for comparison.

Individual wood species often vary greatly in color. In the process of selecting boards for furniture, cabinetry, and millwork, wood stains are commonly used to produce even-colored wood products. In some cases, a variety of shades of wood stains would be used to blend the color of contiguous boards used for a panel. However, minimizing the use of wood stains that are necessary for esthetic blending would naturally enhance visual quality, and at the same time reduce overall product costs.

SUMMARY OF THE INVENTION

This invention relates to an apparatus adapted to categorize random width boards for storage and retrieval. Moreover, without human intervention, selecting a matching plurality of boards from storage, such that, when the boards are subsequently glued together will make up one closely blended unit. The apparatus of the invention provides the ensuing automated tasks, which occur after manually loading the boards on a conveyor track. These tasks include width measuring, color characterization, storing, cataloging, retrieving, and board blending.

A chain conveyor having an input end and an output end. The sides of the conveyor are adjustable and fixed to receive precut boards of a certain length and of a particular species, i.e., pine, oak, maple, etc. The precut boards are supplied with random width dimension in the range from about ¾ inches to about 6 inches. The random width boards are horizontally and laterally placed on a track conveyor. Each board prior to being scanned is stopped, squared up, and released for scanning under a plurality of sensors. A synchronized correlation between an edge detection sensor, positioned to sequentially sense the leading and trailing edge of each board, and an encoder that measures conveyor displacement, computes the width dimension for each board. Moreover, monochromatic sensors, each sensitive to a primary color, are positioned proximate each other for detecting a specific color intensity reflected from each board. The intensity levels, received from each of the sensors, are integrated and recorded. A color signature along with the board's width dimension are electronically identified and tracked for queuing.

The boards are conveyed towards the output end of the conveyor. A multiplicity of lifters is contiguously disposed at each side along the length of the conveyor. The lifters are synchronized to operate in pairs, one from each side, for lifting a single board to a holding level above the conveyor plane. The inventory of boards stored at the holding level is directly related to the length of the conveyor, therefore, the longer the conveyor, the greater the choice for selecting a matching set of boards for making up a panel. The board's queue address and distinctiveness, which includes the board's width and color, are recorded in memory.

After a full inventory of boards at the holding level is completed, a "matched board's" list is generated using the following methodology. Given the widths and colors of all boards currently on the lifters, find the combination of boards that will be equal to or larger than the desired panel width with the minimum total error. Error is a weighted combination of the amount the total width is greater than the desired width and the total amount of color variation among boards in the panel. Once the best combination of boards to make up a panel is determined, "blend" the panel by determining what order the boards should be placed in the set so as to minimize the color variation between each board and it's neighbor. Subsequently, lower the boards in the chosen order to the conveyor surface for transport to the output end where the chosen set is transferred, en masse, to a panel-stacking zone.

DETAILED DESCRIPTION OF THE PREFERRED EMBODIMENT

This invention relates to an apparatus that is adapted to continuously receive hand loaded workpieces, particularly wood-boards and to categorize each by color and width. Furthermore, without human intervention, to routinely select a matching plurality of boards so that when the boards are subsequently glued together will make up one closely blended unit whose overall size is close to a predetermined dimension. The apparatus of the invention provides the following automated tasks, which occur after loading the boards on a conveyor. These tasks include;

a—Measuring width of each board.

b—Detecting the surface color of each board.

c—Storing each board along with attributes.

d—Updating records of stored inventory.

e—Selecting boards from storage so that the accumulated width of the boards is equal to or over a predetermined size and the neighbooring boards are of similar surface color.

Figure 1:
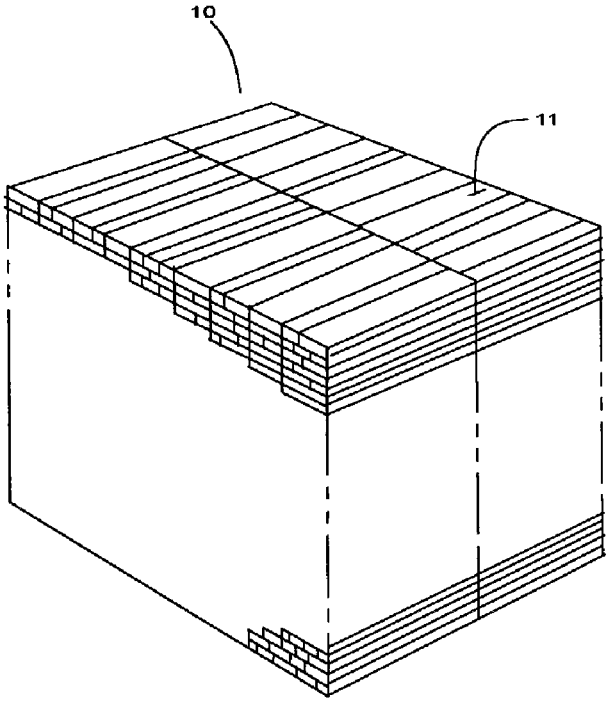
FIG. 1 is a perspective view showing an incoming stack of wood boards to be processed according to the invention.
Figure 3:
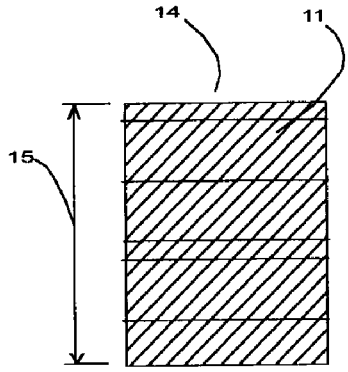
FIG. 3 symbolically illustrates a subset of matching wood boards selected according to the invention.
Figure 2:
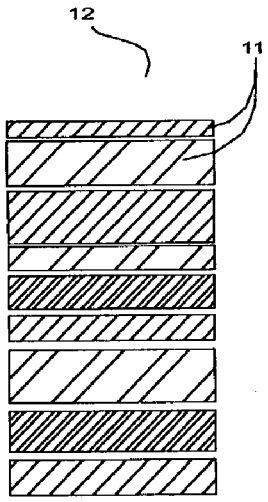
FIG. 2 symbolically illustrates a multiplicity of randomly selected wood boards to be processed according to the invention.
Figure 4:
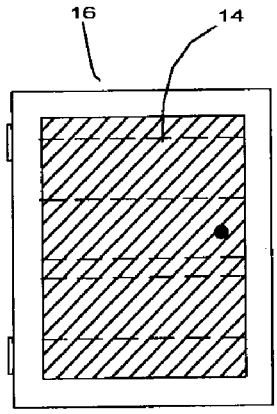
FIG. 4 symbolically illustrates a completed wood panel according to the invention.

FIG. 1 is a perspective view showing a stacked supply 10 containing wood-boards 11 of a particular species, e.g., pine, maple, oak, etc. The boards are precut to a specific thickness and length. The widths may vary from about three quarters of an inch to about six inches. FIG. 2 illustrates a plurality of wood-boards 11 having various widths and color. The boards are randomly selected from the incoming stack, and placed contiguous each other to demonstrate the task of; categorizing by width and color and selecting a matching set from an inventory that blends and conforms to an overall dimension while maintaining a full and updated inventory. The illustration attempts to show dissimilarity between boards by width size and color. Color varies with grain pattern, grain density, and natural stains. FIG. 3 shows a subset 14 with matching color blended boards 11, also, the sum of each board's width must measure at or above a prescribed overall dimension 15. FIG. 4 shows a completed panel 16 made up from subset 14.

The workpieces are processed in the following manner: 1) measures a board's width by detecting its leading and trailing edges thereafter calculating its width from its traversed distance; 2) sensing colors reflected from each board; 3) electronically labeling and storing a plurality of boards in a holding area; 4) determining the best combination of boards from the stored plurality that will be equal to or larger than the desired panel width with a minimum total error of width and color; 5) queuing and releasing the best combination of boards from the stored plurality to make a panel with a minimum of color variation between contiguous boards, and 6) continuously replacing and updating the stored inventory.

Figure 5:
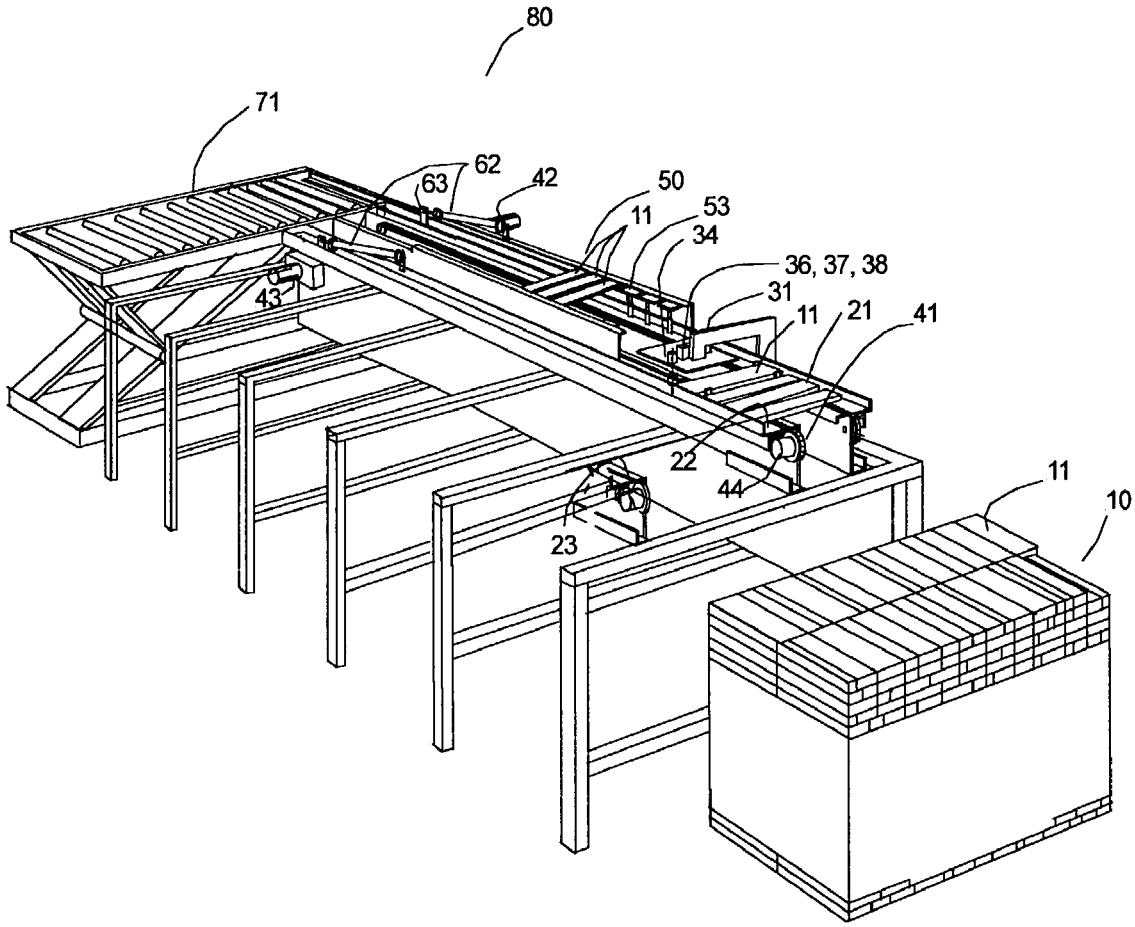
FIG. 5 is a perspective illustration of the linear configuration of the apparatus according to the invention.
Figure 6:
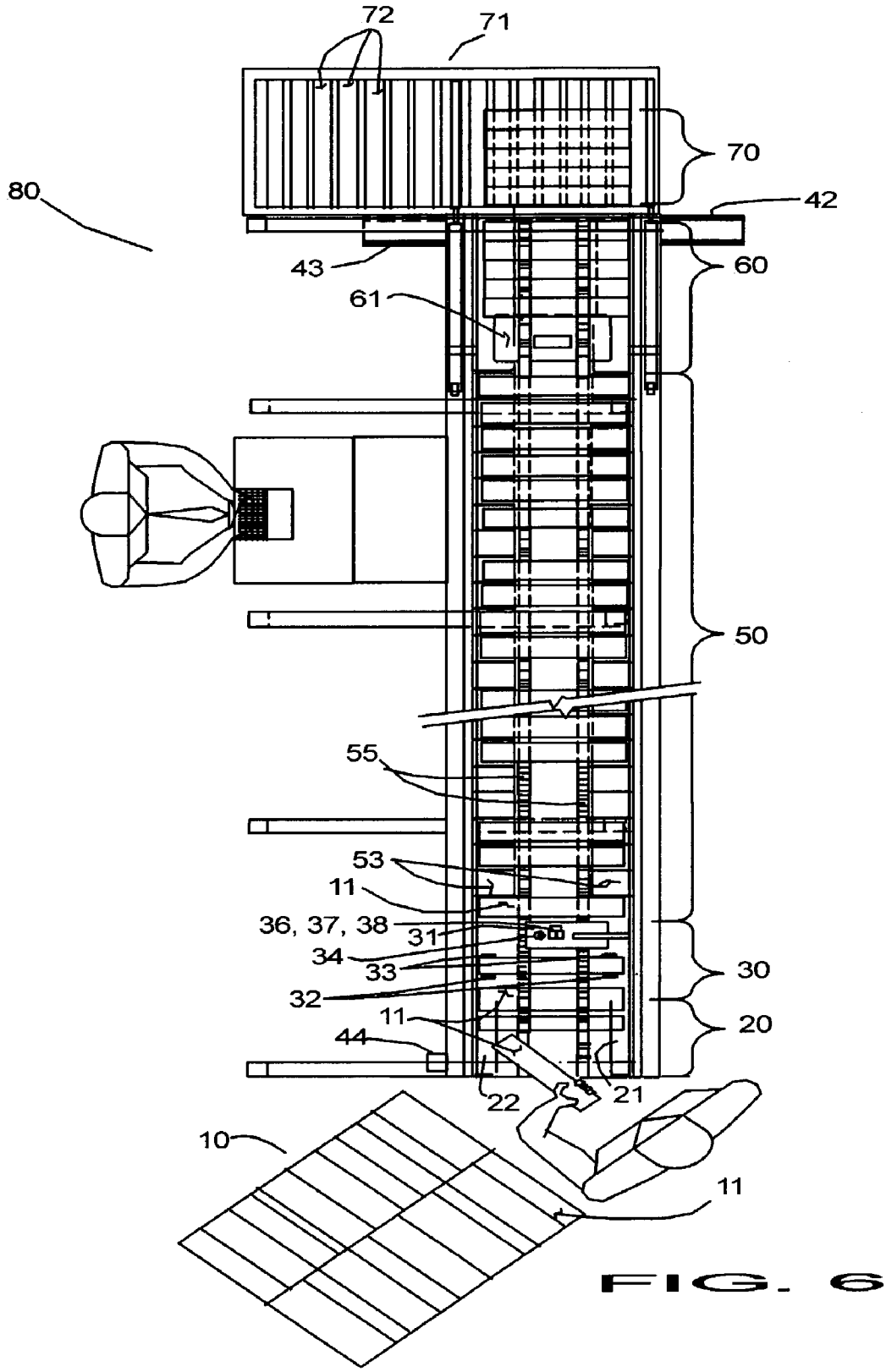
FIG. 6 shows a top view illustrating various sectors making up the apparatus according to the invention.
Figure 7:
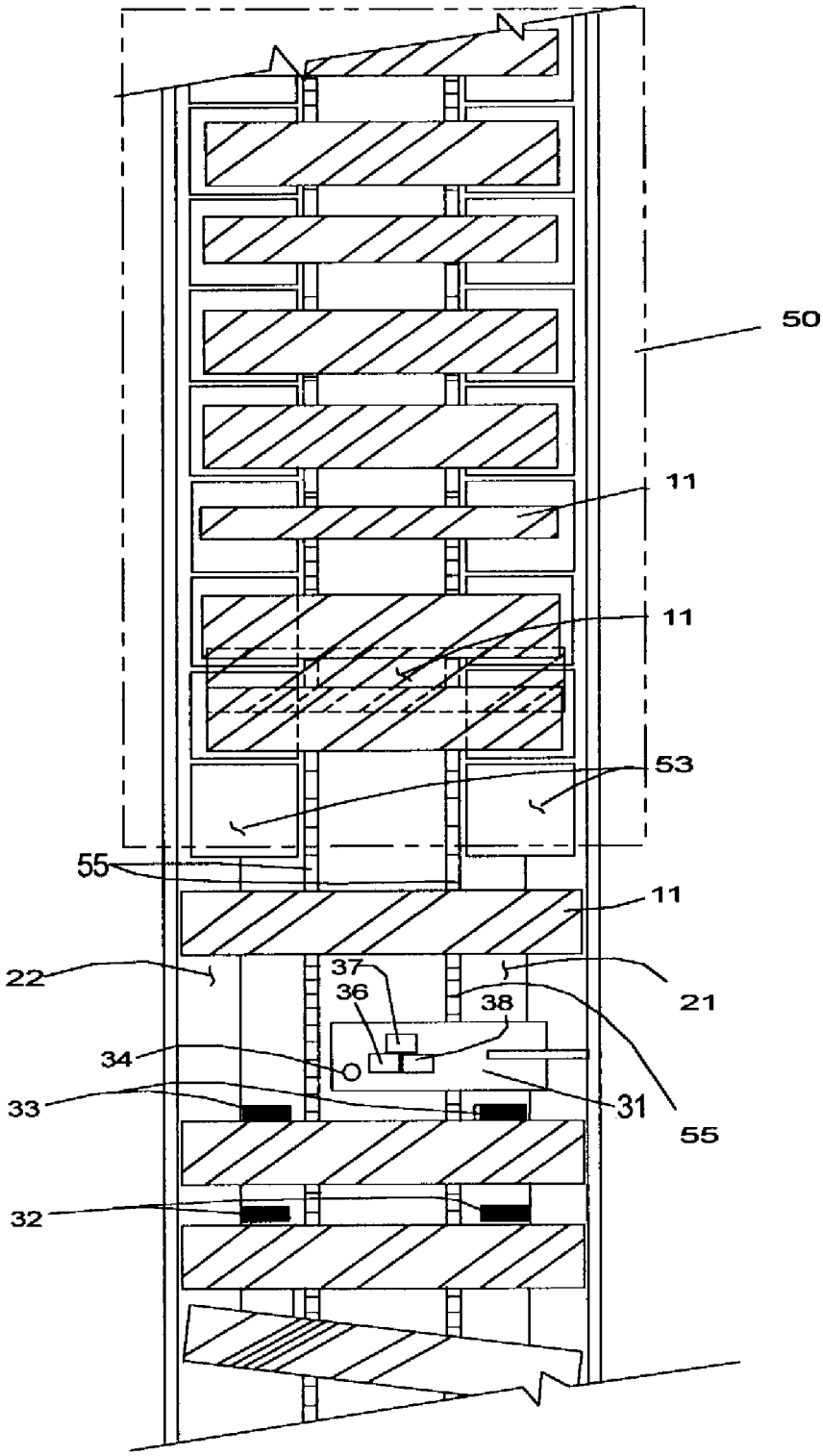
FIG. 7 illustrates a top view of a portion of the handling and queuing sector according to the invention.

Referring now to the preferred embodiment, and particularly to FIGS. 5, 6, and 7 while also making references to FIGS. 8 through 11 that show sequential operations of a portion of the apparatus during the handling of the wood-boards 11. FIG. 5 is a perspective and symbolic illustration of the apparatus, while FIG. 6 gives an overall systems configuration. A stacked supply 10 of wood-boards 11, precut in length and thickness but vary in width between about ¾ inch to about 6 inches, is positioned for an operator to handily place one board at a time, flat and crossways spanning conveyor guides 21 and 22. The operator gives each board a cursory look to quickly determine the better of the two sides to face upwards while rejecting those with obvious anomalies. Conveyor guide 22 is laterally adjustable to accommodate longer boards. This lateral adjustment is partially shown in position 23. The apparatus is designed to operate routinely with a continuous supply of boards placed on its conveying surface.

FIG. 6 is a plan view showing the linear configuration of apparatus 80 divided into five sectors, an input sector 20, scanning sector 30, lifter/storage sector 50, collector/transfer sector 60, and output sector 70. The random width boards 11 are manually removed from the stack 10 and placed, one at a time, flat and crossways on supporting surfaces 21, 22 at the input sector 20. A conveyor consisting of a pair of continuous and parallel conveyor chains spanning the length from the input sector to the collector/transfer sector 60. Each of the conveyor chains are looped around sprockets and driven by separate motors 42, 43. The motors run at about the same speeds, driving the conveyor belts synchronously. An incremental shaft encoder 44 is also coupled to one conveyor. The encoder 44 interfaces with a computer to translate pulses giving increment displacement signals to be processed by a simple counter circuit for use by a microprocessor.

Refer also to FIG. 7 showing a more detailed view of sectors 20, 30 and 50. Prior to processing the boards, a first pair of gates 32 and a second pair 33 are in a raised position. Gate 32 prevents the boards from advancing while momentarily sliding in place as the conveyor chain continues to run. Gates 32 and 33 are normally in the raised position. A sensor (not shown) senses a board as it nears the first pair of gates 32 that provides a signal indicating that there are an adequate number of boards at the input end to begin processing. The computer controls the operating of the gates. Both pairs working in unison, momentarily trapping the board between them. The continuous movement of the conveyor urges the board against the second pair of gates 32, appropriately squaring the board to the direction of travel of the conveyor. This action is followed by lowering of the gates to permit the board's entrance into the scanning sector 30 while trapping the next board in line. In the scanning sector, the board passes under a plurality of sensors. A synchronized correlation between an edge detection sensor 34, positioned to sequentially sense the leading and trailing edge of each board, and an encoder 44 that measures conveyor displacement, provides the necessary data for computing the width dimension for each board. Detection of the leading edge initiates the scanning of three light sensors, 36, 37, 38 each sensitive to a primary color range, are positioned proximate each other to detect color intensity levels reflected from each board. After the trailing edge from a board is detected, scanning is terminated and a coded signature is assigned to the board. The coded signature consists of the board's average color composite, and its width dimension.

Figure 8:
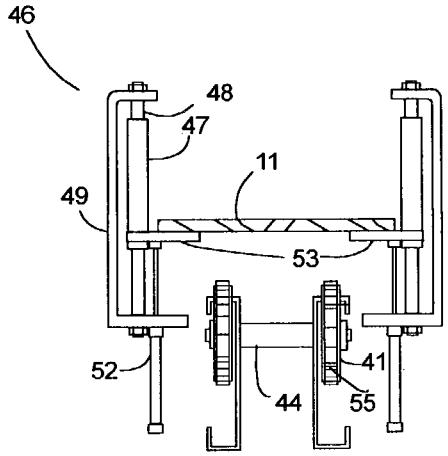
FIG. 8 shows a cross-sectional end view of the apparatus illustrating a stored wood board at the holding level of the lifter sector according to the invention.
Figure 10:
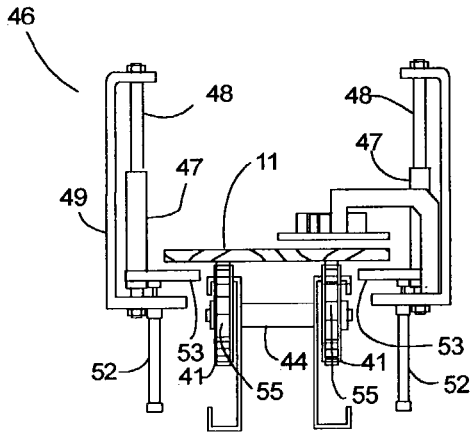
FIG. 10 shows a cross-sectional end view illustrating a wood board passing under the edge and color detectors in the scanning sector according to the invention.
Figure 9:
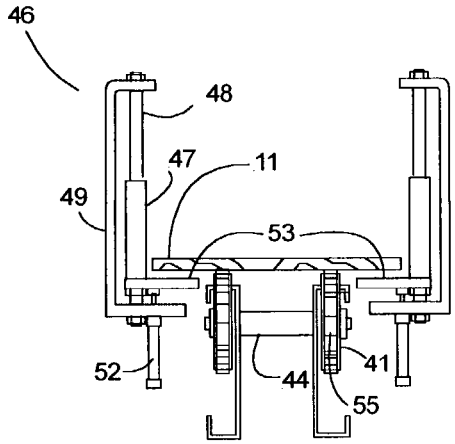
FIG. 9 shows a cross-sectional end view illustrating the lowering of a stored wood board from the holding level, of the lifter sector, to the conveyor level according to the invention.
Figure 11:
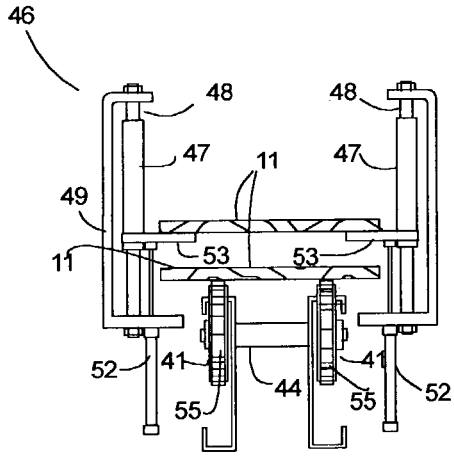
FIG. 11 shows a cross-sectional end view illustrating a wood board stored at the holding level in the lifter sector while a wood board is being transported at the conveyor level according to the invention.

The boards are conveyed to the lifter/storage sector 50. A multiplicity of lifters 53 is contiguously disposed at each side along the length of the lifter/storage sector. Lifters 53 are synchronized to operate in pairs, one from each side, to lift a single board to a holding level above the conveyor plane. The inventory of boards stored at the holding level is directly related to its filled capacity and the length of the conveyor, therefore, the longer the conveyor, the greater the choice for selecting a matching set of boards for making up a panel. The operating sequence therefore, requires filling each of the lifter/storage positions prior to selecting and queuing the best-matched set from the filled inventory of boards. FIGS. 8, 9, 10, and 11 are end views 46 having common numbered items in each of the Figs. and will be described in FIG. 8 and not the others. Each of the end views 46 illustrates various sequences in the operation of the lifters 53. FIG. 8 shows a board 11 lifted to a holding level by lifter 53. A pair of tubular guide bearings 47 attached to each lifter is slideably engaged by shafts 48 fixed at each end to bracket 49. The extended and retracted positions of each set of lifters are set in motion by linear actuators 52 that are synchronized in pairs in response to a tool microprocessor (not shown). Conveyor chain 55 is shown looped around sprocket 41. The board's queue address and distinctiveness, which includes the board's width and color, are recorded in memory. FIG. 9 shows the lifters 53 below the conveyor chain 55 permitting the board 11 to pass over the lifters without interference. FIG. 10 depicts the board 11 passing under the scanner in the scanning sector 30. FIGS. 7 and 11 show a board 11 on the conveyor chain 55 passing under another board stored in the holding position. This interchange is ongoing since other previously scanned boards are constantly replacing selected boards from the holding level.

After receiving a full inventory of boards at the holding level, a "matched board's" list is generated using the following methodology. Given the widths and colors of all boards currently on the lifters, find the combination of boards that will be equal to or larger than the desired panel width with the minimum total error. Error is a weighted combination of the amount the total width is greater than the desired width and the total amount of color variation among boards in the panel. Once the best combination of boards to make up a panel is determined, "blend" the panel by determining what order the boards should be placed in the set so as to minimize the color variation between each board and it's neighbor. Subsequently, the selected boards are lowered, in order, to the conveyor chains for transport to the output end where the chosen set is transferred, en masse, to a panel-stacking zone. As a selected board is lowered and taken away, a replacement board is lifted to fill its vacancy. This sequence is continuous until the stacked supply of boards is completely processed.

Figure 12:
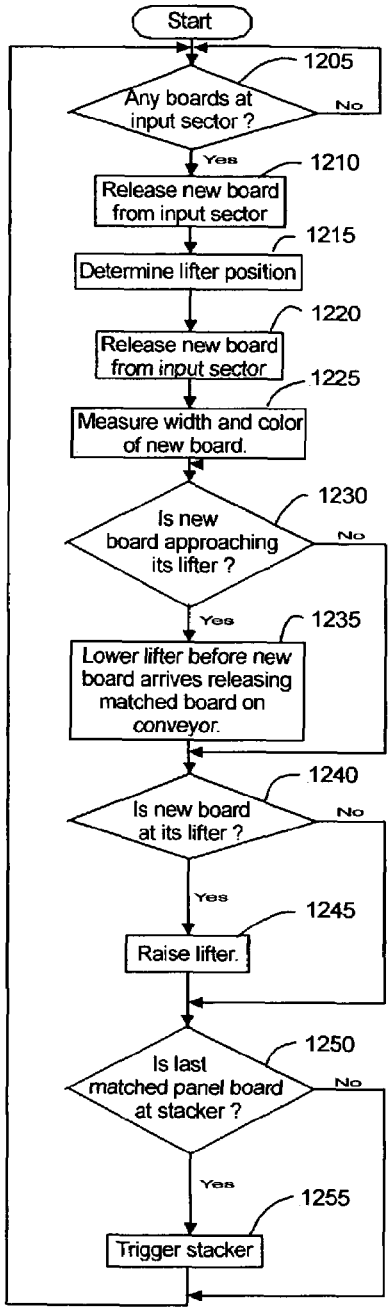
FIG. 12 is a flow chart indicating the manner in which the microprocessor controlling the apparatus shown in FIG. 6 operates to sort the wood boards by size and color.
Figure 12:
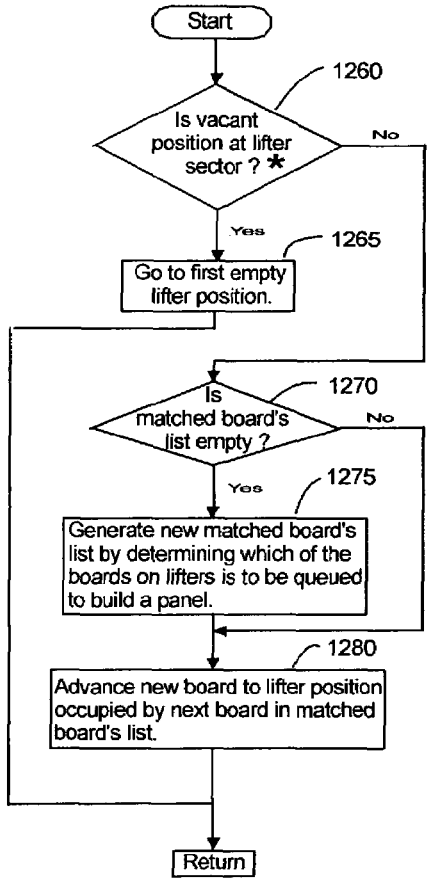

FIG. 12 outlines a microprocessor's iterative control steps performed during the processing of the wooden boards. Also refer to FIGS. 6 and 7 for referenced item numbers. In step 1205, a photoelectric sensor positioned proximal the entrance to gate 32 continuously searches for a board. If a new board is detected, step 1210 releases the new board from the input sector. The new board is momentarily trapped between gates 32 and 33 while squaring up to against gate 33. The microprocessor determines and assigns a lifter address from memory as stated in step sequence 1215. In step 1220 the microprocessor executes lowering of gates 32 and 33 releasing the new board to the scanning sector. When edge detector 34 detects the leading edge of the new board, the microprocessor initializes an encoder count of zero and continues to add to its forward movement from its initial point to its assigned lifter address. In step 1225, the board's width and color are measured and electronically assigned a descriptive label, which complies with step 1230. In step 1235, the assigned lifter lowers and releases a matched board to the collector/transfer sector 60, and in step 1240 the microprocessor and encoder compare incremental counts which satisfies the incremental lifter address for the new board for lifting the new board, step 1245, to the holding level.

The microprocessor executes all the steps in a parallel mode. Concomitantly therefore, step 1250 is continuously looking for the last board that completes a matched panel set at the collector/transfer sector 60. When the last board arrives, the stacker pushes the matched set to the output sector 70.

A second flow chart explains the control logic regarding the queuing of the new board and the updating of the matched board's list. In step 1260, which applies only when starting a new batch of wood-boards, the microprocessor repetitively interrogates the matched board's list for vacant lifter positions. The remainder of steps 1265 through 1280 explains the microprocessor's real time execution for queuing boards and maintaining an updated matched board's list based on an ever-changing inventory of wood-boards.

While the invention has been particularly shown and described with reference to the preferred embodiments thereof, it will be understood by those skilled in the art that various changes in form and details may be made without departing from the spirit and scope of the invention.

What is claimed is:

1. Apparatus for processing random width workpieces of equal lengths said apparatus comprising:

a means to move said workpieces;

a means to measure and record surface color and width of said workpieces;

a means to store said workpieces;

a means for recalling a selected plurality of stored workpieces from a fully stored inventory;

a means for ranking said workpieces according to surface color and width so a collective set recalled from said fully stored inventory has a blended color and overall dimension that is equal to or larger than a specified size, and, a means to compile said collective set into intermediate products.

2. The apparatus of claim 1, further comprising:

a conveyor and drive means adapted for movement of said workpieces in a longitudinal path;

an encoding means to track position of said conveyor;

a programmable processor, interacting with said encoding means, for tracking storage location for each of said workpieces.

3. The apparatus of claim 1, further comprising gate means for momentarily trapping a single workpiece from other advancing workpieces, and said gate means laterally adjusts and releases said workpiece to direction of conveyor travel.

4. The apparatus of claim 1, further comprising:

a scanning sector including an edge detector for providing a signal when detecting a leading edge and a trailing edge of said workpiece while workpiece is moving, and at least three photo sensors, disposed proximate each other, each photo sensor providing a primary color signal while workpiece is moving;

5. The apparatus of claim 1, further comprising:

a microprocessor responsive to said leading edge signal to initiate counting of encoder pulses for measuring conveyor displacement, and to initiate reception of color signals from said photo sensors;

said microprocessor responsive to detection of said trailing edge signal to compute said workpiece's width dimension, and to terminate reception of color signals from said photo sensors;

said microprocessor transforms said color signals to an integrated color value for said workpiece, said integrated color value in combination with said width dimension is assigned a label and stored in memory.

6. The apparatus of claim 1, further comprising:

a lifter storage sector containing a plurality of lifter pairs, said lifter pairs including a lifter disposed under and at each side of said conveyor, said lifter pairs operate to lift and hold said workpiece in an elevated storage position;

operation of said lifter pairs is responsive to said microprocessor and encoder position count.

7. The apparatus of claim 1, further comprising:

a collector/transfer sector for accruing a prescribed set of workpieces from said lifter storage sector, and transferring said set of selected workpieces to a stack accumulator.

8. The apparatus of claim 1 wherein said conveyor is in a continuous operating mode when power is turned on.

9. The apparatus of claim 3 wherein said gate means laterally adjusts said workpiece resulting from said conveyor urging workpiece against said gate means.

10. The apparatus of claim 2 wherein said encoding means is selected from the group consisting of incremental and absolute optical shaft encoders.

11. The apparatus of claim 4 wherein said edge detector includes a light emitting device disposed under path of said workpiece and a light sensor disposed above path of said workpiece.

12. The apparatus of claim 4 wherein said three photo sensors are sensitive to red, green, and blue spectral components, respectively, said microprocessor executing a color signal transformation while the workpiece is moving and assigns a color signature to said workpiece at termination of scanning.

13. The apparatus of claim 6 wherein said lifter storage sector must be at maximum capacity prior to matching and releasing workpieces from storage.

14. The apparatus of claim 2 wherein said encoder and microprocessor function together as a sensor based system to track each workpiece from the point of detection of its forward edge to the point of being selected and queued for release.

15. A method for processing random width wooden boards of equal length to form color matched panels having similar rectangular dimensions, said method comprising the steps of:

providing a supply of said boards for manual access;

providing a conveyor adapted for movement of said boards in a longitudinal path;

providing an encoder to track linear displacement of said conveyor;

placing boards on said conveyor;

providing sensors for characterizing and recording surface color and width for each board;

providing a plurality of storage cells with address tracking means for storing;

filling said plurality of storage cells to maximum capacity each cell containing one characterized board;

selectively removing best matched boards, according to recorded attributes so a collective set of boards will be color blended and have a combined overall dimension that is equal to or larger than a specified dimension;

amassing said collective set of boards for subsequent intermediate products.

16. The method according to claim 15, further comprising the steps of:

providing a programmable processor, interacting with said encoder, for tracking storage location for each of said boards.

17. The method according to claim 15, further comprising the steps of:

providing gate means for momentarily trapping a single board from other advancing boards, and adjusting said gate means and releasing said board to direction of conveyor travel.

18. The method according to claim 15, further comprising the steps of:

providing a sensor for detecting a leading edge and a trailing edge of said board while board is moving, and providing at least three photo-sensors that are disposed proximate each other, each photo-sensor providing a primary color signal response while board is moving.

19. The method according to claim 18, further comprising the steps of:

providing a microprocessor that is responsive to said leading edge signal to initiate a counting of encoder pulses for measuring conveyor displacement, initiating reception of color signals from said photo-sensors and, detecting trailing edge signal for computing a board's width dimension and terminating reception of color signals from said photo sensors;

transforming said color signals to an integrated color value for said board, said integrated color value in combination with said width dimension is given a label and stored in memory.

20. The method according to claim 15, further comprising the steps of:

providing a collector/transfer sector for accruing a set of selected boards from said plurality of storage cells, and transferring said set of selected boards to a stack accumulator.

21. The method according to claim 16, further comprising the steps of;

providing a conveyor to be in a continuous operating mode when power is turned on.

22. The method according to claim 17, further comprising the steps of;

allowing continuous movement of said conveyor to urge a leading board against said gate for laterally aligning said board to direction of travel.

23. The method according to claim 18, wherein providing a sensor for detecting the leading and trailing edge includes a light emitting device disposed under path of said board and a light sensor disposed above path of said board.

24. The method according to claim 18, wherein providing three photo sensors sensitive to red, green, and blue spectral components, therewith communicating values to, said microprocessor for executing a color signal transformation while the board is moving and assigns a color signature to said board at termination of scanning.

25. The method according to claim 15, wherein said providing a plurality of storage cells that must be at maximum capacity prior to matching and releasing boards from storage.

26. The method according to claim 16 wherein providing an encoder and programmable processor to function together as a sensor based system to track each board from the point of detection of its forward edge to the point of being selected and queued for release.

27. An apparatus for gathering wood-boards to form intermediate products of a predetermined size and of uniform color, said apparatus comprising:

a conveyor for moving said wood-boards;

sensors to measure and record surface color and width of each board;

means for encoding and recording conveyor position;

storage space longitudinally disposed parallel and above said conveyor for storing said measured boards;

a means to rank and to withdraw a plurality of stored boards according to surface color and width so a collective set made from said boards has a blended color and overall dimension that is equal to or larger than a specified size;

a means for gathering loosely assembled wood-boards and placing said boards into a vertical stack.

28. The apparatus of claim 27, further comprising:

said conveyor and conveyor driver adapted for movement of said boards in a longitudinal path;

an encoder to measure linear displacement of said conveyor;

a programmable processor interacting with said encoder.

29. The apparatus of claim 27, and further comprising:

stops for momentarily trapping a single board from other advancing boards, and said stops align and release said single board to direction of conveyor travel.

30. The apparatus of claim 27, and further comprising:

a scanning sector including an edge detector for providing a signal when detecting a leading edge and a trailing edge of said board while board is moving, and at least three photo sensors, disposed proximate each other, each photo sensor providing a primary color signal while board is moving.

31. The apparatus of claim 30, and further comprising:

a microprocessor responsive to said leading edge signal by counting encoder pulses for measuring conveyor displacement, and to initiate reception of color signals from said three photo sensors;

said microprocessor responsive to detection of said trailing edge signal to compute a width dimension for said board, and to terminate reception of color signals from said photo sensors;

said microprocessor transforms said color signals to an integrated color value for said board, said integrated color value in combination with said width dimension are recorded in memory along with said encoded storage location for future retrieval of said board.

32. The apparatus of claim 27, further comprising:

a lifter storage sector containing a plurality of lifter pairs, said lifter pairs including a lifter disposed under and at to each side of said conveyor, said lifter pairs operate to lift and hold said board in an elevated storage position;

operation of said lifter pairs is responsive to said microprocessor and an encoder position count.

33. The apparatus of claim 27 wherein a collector/transfer sector accumulates a prescribed set of selected boards from said lifter storage sector, and transfers said set of gathered boards to a stack accumulator.

34. The apparatus of claim 27 wherein said conveyor is in a continuous operating mode when power is turned on.

35. The apparatus of claim 27 wherein said gate means laterally adjusts said board resulting from said conveyor urging board against said gate means.

36. The apparatus of claim 27 wherein said encoder is selected from the group consisting of incremental and absolute optical shaft encoders.

37. The apparatus of claim 27 wherein said edge detector includes a light emitting device disposed under path of said board and a light sensor disposed above path of said board.

38. The apparatus of claim 30 wherein said three photo sensors are sensitive to red, green, and blue spectral components, respectively, said microprocessor executing a color signal transformation while the board is moving and assigns a color signature to said board at termination of scanning.

39. The apparatus of claim 27 wherein said lifter storage sector must be at maximum capacity prior to matching and releasing boards from storage.

40. The apparatus of claim 27 wherein said encoder and microprocessor function together as a sensor based system to track each board from the point of detection of its forward edge to the point of being selected and queued for release.

* * * * *